US010378335B2

(12) United States Patent
Chong

(10) Patent No.: US 10,378,335 B2
(45) Date of Patent: Aug. 13, 2019

(54) PRESSURE TESTING OF WELL SERVICING SYSTEMS

(71) Applicant: SCHLUMBERGER TECHNOLOGY CORPORATION, Sugar Land, TX (US)

(72) Inventor: Jonathan Wun Shiung Chong, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 41 days.

(21) Appl. No.: 14/198,736

(22) Filed: Mar. 6, 2014

(65) Prior Publication Data

US 2014/0274557 A1 Sep. 18, 2014

(30) Foreign Application Priority Data

Mar. 13, 2013 (WO) ..... PCT/US2013/030871

(51) Int. Cl.
*E21B 47/10* (2012.01)
*E21B 47/06* (2012.01)
(Continued)

(52) U.S. Cl.
CPC ..... *E21B 47/10* (2013.01); *Y10T 477/641* (2015.01)

(58) Field of Classification Search
CPC ..... E21B 47/06; F16D 48/00; F16H 47/04
See application file for complete search history.

(56) References Cited

U.S. PATENT DOCUMENTS 1,505,165 A * 8/1924 Reeves ..... F24D 19/081 417/201
2,096,150 A * 10/1937 Walne ..... E21B 3/02 74/661

(Continued)

OTHER PUBLICATIONS

Dong, "Designing Requirement Driven Product Development Process", Massachusetts Institute of Technology Engineering Systems Division, Working Paper Series, ESD-WP-2002-03, Sep. 2001, 12 pages.

(Continued)

*Primary Examiner* — Giovanna C Wright
*Assistant Examiner* — Manuel C Portocarrero

(57) ABSTRACT

An apparatus and methods for testing and pumping through a well servicing system are provided. The apparatus includes a drive mechanism and an actuation system. The actuation system is coupled to the drive mechanism for selectively engaging the drive mechanism to a drive train of the well servicing system's pumping equipment for pressure testing and low rate pumping of the well servicing system without using the primary mover of the pumping equipment. A method for hydrostatic pressure testing of the well servicing system includes putting a transmission of the drive train into neutral and containing the well servicing system, then engaging the drive mechanism to the drive train and activating the drive mechanism to drive the drive train for pumping and compressing test fluid into the well servicing system without using the primary mover. And a method for low rate pumping of an open well servicing system includes putting the transmission of the drive train into neutral, engaging the drive mechanism to the drive train, and activating the drive mechanism to drive the drive train for pumping fluid into the well servicing system at a predetermined flow rate without using the primary mover.

19 Claims, 6 Drawing Sheets

(51) Int. Cl.
*F16D 48/00* (2006.01)
*F16H 47/04* (2006.01)

(56) References Cited

U.S. PATENT DOCUMENTS

| | | | | |
|---|---|---|---|---|
| 7,533,730 | B1 | 5/2009 | Corsentino et al. | |
| 7,563,076 | B2 | 7/2009 | Brunet et al. | |
| 8,146,416 | B2 | 4/2012 | Pisio et al. | |
| 9,010,429 | B2 * | 4/2015 | Shampine | E21B 43/25 166/305.1 |
| 2008/0066915 | A1 | 3/2008 | Shampine | |
| 2008/0182699 | A1 | 7/2008 | Salvaire et al. | |
| 2010/0156338 | A1 * | 6/2010 | Lu | H02P 29/64 318/798 |
| 2014/0205475 | A1 * | 7/2014 | Dale | F04D 13/086 417/351 |

OTHER PUBLICATIONS

International Search Report and Written Opinion for corresponding International App. No. PCT/US2013/030871 dated Nov. 13, 2013, 9 pages.

Zhiqiang, "Engineering approach for human error probability quantification", Journal of Systems Engineering and Electronics, vol. 20, Issue 5, Oct. 2009, 1144-1152.

Written Opinion issued in Singapore Application No. 1120150726Q dated Apr. 28, 2016; 8 pages.

* cited by examiner

PRESSURE TESTING OF WELL SERVICING SYSTEMS

BACKGROUND

This application claims priority to International Patent Application Serial No. PCT/US2013/030871, filed Mar. 13, 2013, which is incorporated by reference herein in its entirety.

Pressure pumping is an integral part of well services such as stimulation and cementing that deliver required fluids using pumping equipment of a well servicing system at high pressures and flow rates. It is therefore of the utmost importance that the integrity of the well servicing system is tested and maintained.

Hydrostatic pressure testing is one type of pressure testing method, and is a way in which pressure containing components in a well servicing system (land-based or offshore) can be tested for their integrity. For offshore pressure pumping, a significant amount of the equipment's operational time is spent performing hydrostatic pressure tests. During a hydrostatic pressure test, a well servicing system (defined from here forth as components forming a fluid delivery or containment system, such as pumping equipment, pump fluid end, treating lines, rig treating lines, well head, casing, tubular, open hole formation) is subjected to a specific target internal pressure and the pressure is held in this closed and contained system for a predetermined period of time to reassure its strength or to detect leaks, if any. The system is contained by means such as using closed valves in the treating lines or the casing and down-hole formation. A hydrostatic pressure test is typically carried out using pressure pumps, e.g., positive displacement pumps, in fluid communication with the system to pressurize this system to a test pressure. During this test, a testing medium is pumped into the system by the pressure pumps until the system is fully primed. In order to build up pressure in this system volume, the pump further displaces and compresses the medium. Once the target pressure is reached, the pressure is held for a specified time.

In order to verify the integrity of the system, pressure tests up to the rated working pressure of certain components is highly desirable, in part, to ensure that no incident of over-pressuring occurs, thereby compromising safety and leading to costly downtime to conduct repairs or replace components. This is even more so, considering the high frequency of hydrostatic tests and the potential high pressures involved during such testing.

Pumping equipment may consist of a primary mover that is either a Reciprocating Internal Combustion (RIC) engine, an electric motor, or the like, which is coupled to a transmission or gear box for speed and torque control, and which further drives a high pressure pump. The primary limitations of the RIC engine compared to the electric motor in terms of pressure testing, are (1) the RIC engine cannot operate at low speeds and hence have low resolution in terms of pressure increase at the driven pump, and (2) the RIC engine is typically coupled to a transmission that has a minimum allowable input speed, hence contributing to low resolution if this speed is too high. Some variants of pumping equipment with electric motors as primary movers also employ these transmissions, hence creating the same issue as described in (2).

The most widely used method for pressure testing systems that have a transmission is a trial-and-error approach, where the primary mover is set at idle speed (for an electric motor, this speed will correspond to the minimum allowable input speed to the transmission) and subsequently 'bumping' by moving from in-gear to neutral repetitively to increase pressure. If the pressure in the system is still inadequate, the primary mover's torque is typically increased by increasing its speed. Preventing any over-pressure incident in this widely used method depends on how quickly the pump can be stopped by shifting the transmission to neutral when the desired test pressure is reached. This depends on both the ability of the equipment operator and the characteristics of the equipment. In terms of the equipment, there are three primary factors that affect the controllability of the method: (1) the behavior and torque multiplication of the transmission in torque converter (fluid coupling) mode is difficult to predict as it is a function of a number of parameters such as torque converter geometry and oil characteristics; (2) the 'bumping' method uses momentum to increase the pressure, and this is highly unpredictable and can cause significant damage to the transmission after repeated tests; and (3) the nature of the reciprocating pump means that the load is varying as a function of the crank angle, implying that even if the exact same steps are taken for every test, the resultant pressure increase will be different if the crank angle is not the same every single time. The current industry trend of requiring higher powered pumping equipment especially for deepwater rigs, further compounds these issues.

A few scenarios that are inadequately addressed by current methods are (1) low pressure tests (e.g., 500 pounds per square inch (psi)) where the larger the equipment, the lower the resolution in terms of pressure increase which may lead to single bumps of even higher than 500 psi, (2) small volume tests (e.g., local treating lines of the pumping equipment), and (3) reaching close to the target pressure but not yet within the allowed +/− acceptance range while not being able to confidently take the next step for fear of over-pressuring. Currently, Over-Pressure Shut-Down (OPSD) systems are used to address this, however this method is more of a 'reactive' approach and requires very quick response times that may not be practical or achievable.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to an aspect of the present disclosure, one or more embodiments relate to an apparatus for use with pumping equipment for a well servicing system having a primary mover coupled to a pump by a drive train. The apparatus includes a separate drive mechanism and an actuation system. The actuation system is coupled to the drive mechanism for selectively engaging the drive mechanism with the drive train for pressure testing of a well servicing system without using the primary mover. With regard to at least one embodiment recited herein, the phrase "without using the primary 'mover" for pressure testing refers to not using the primary mover for driving the drive train during pressure testing of the well servicing system in the way current methods, such as 'bumping', use the primary mover.

According to another aspect of the present disclosure, one or more embodiments relate to a method for hydrostatic pressure testing of a well servicing system using pumping equipment having a primary mover coupled to a pump by a drive train comprising a transmission. The method includes putting the transmission into neutral and containing the well servicing system. The method then includes engaging a hydrostatic pressure test drive mechanism with the drive train and activating the hydrostatic pressure test drive mechanism to drive the drive train for pumping and compressing test fluid into the well servicing system without using the primary mover.

According to yet another aspect of the present disclosure, one or more embodiments relate to a method for low rate pumping of an open well servicing system using pumping equipment and including a primary mover coupled to the pumping equipment by a drive train comprising a transmission. The method includes putting the transmission into neutral, engaging a low rate pumping drive mechanism with the drive train, and activating the low rate pumping drive mechanism to drive the drive train for pumping fluid into the open well servicing system without using the primary mover. With regard to at least one embodiment recited herein, the phrase "without using the primary mover" for low rate pumping refers to not using the primary mover for driving the drive train during low rate pumping of the open well servicing system in the way current methods, such as pumping in transmission torque converter mode and transmission mechanical lockup mode, use the primary mover.

According to another aspect of the present disclosure, one or more embodiments relate to well services pumping system. The well services pumping system includes pumping equipment, a drive mechanism for performing pressure testing and low rate pumping, and a coupler. The coupler has a predetermined gear ratio for coupling the drive mechanism to the pumping equipment, where the predetermined gear ratio is selected from a first predetermined gear ratio satisfying pressure testing requirements, a second predetermined gear ratio satisfying low rate pumping requirements or a third predetermined gear ratio satisfying both pressure testing requirements and low rate pumping requirements.

BRIEF DESCRIPTION OF THE DRAWINGS

To assist those of ordinary skill in the relevant art in making and using the subject matter hereof, reference is made to the appended drawings, which are not intended to be drawn to scale, and in which like reference numerals may to refer to identical or functionally similar elements throughout the separate views for consistency. For purposes of clarity, not every component may be labeled in every drawing.

FIG. 1, comprising FIG. 1A illustrates a system without the test apparatus illustrated in FIG. 2, while FIG. 1B illustrates the pumping equipment with the test apparatus of FIG. 2.

FIG. 2, comprising FIG. 2A is a right side planar view of the test apparatus, FIG. 2B is a top planar view of the test apparatus, FIG. 2C is a front planar view of the test apparatus, and FIG. 2D is a top, right, rear perspective view of the test apparatus.

DETAILED DESCRIPTION

Specific embodiments of the present disclosure will now be described in detail with reference to the accompanying drawings. Further, in the following detailed description of embodiments of the present disclosure, numerous specific details are set forth in order to provide a more thorough understanding of the claims recited herein. However, it will be apparent to one of ordinary skill in the art that the embodiments disclosed herein may be practiced without these specific details. In other instances, well-known features have not been described in detail to avoid unnecessarily complicating the description.

The terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

Pressure pumping is an integral part of well service operations, such as stimulation and cementing services, and involves high pressures and flow rates incurred during the operations. In addition, the size of pumping equipment has increased over the past two decades due to the increasing power requirements, thereby requiring well servicing system integrity testing which does not require removal or disconnection of one or more parts of the well servicing system.

Figure 1A:
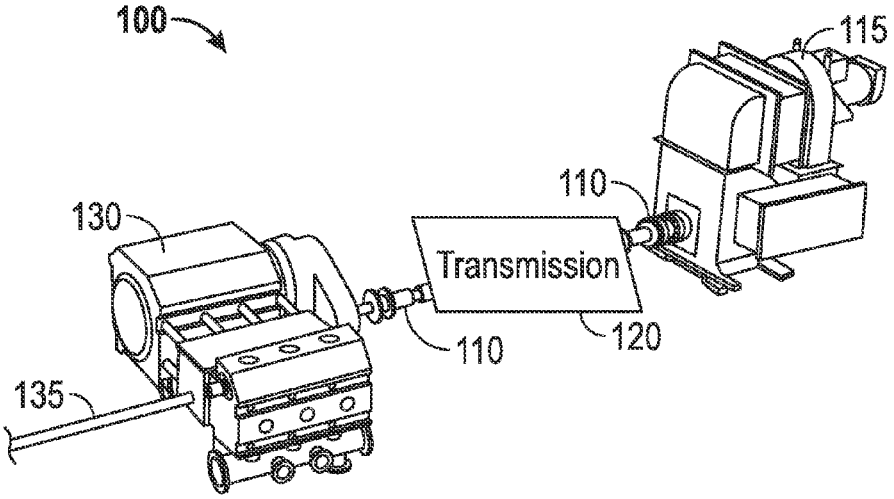
FIGS. 1A and 1B, illustrates pumping equipment for well servicing systems in accordance with at least one aspect of the present disclosure, where

Referring to FIG. 1, pumping equipment 100 for a well servicing system is depicted. FIG. 1A depicts a single drive train 110 of the pumping equipment 100 that consists of a primary mover 115 (e.g., RIC engine or electric motor), a transmission 120 (such as a drive train transmission or a gear box), and one or more drive shafts. The pumping equipment 100 also consists of a pressure pump 130, and discharge lines 135 leading away from the pump 130 into the well servicing system.

The minimum speed at which the engine 115 can operate is its idling speed (e.g., seven hundred revolutions per minute (rpm) for an RIC engine). Although an electric motor can run at a relatively low speed (e.g., five revolutions per minute (rpm)), when the transmission 120 is involved in the drive train 110 then the minimum operating speed of the primary mover 115 cannot be any lower than the minimum allowable input speed of the transmission 120 (e.g., five hundred revolutions per minute (rpm)).

Figure 1B:
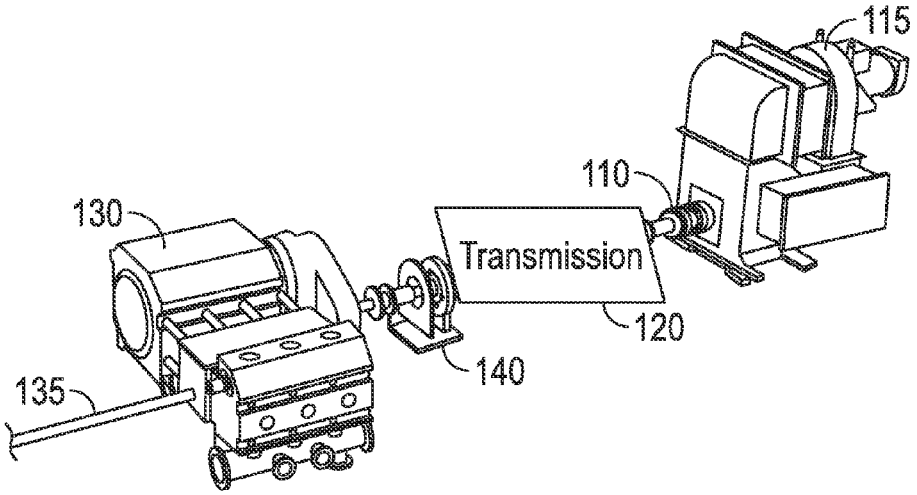

FIG. 1B depicts a similar system as shown in FIG. 1A, but with the addition of a test apparatus 140 shown to be engaged to the drive train and can be activated for performing pressure testing of a well servicing system in accordance with the present embodiment.

Referring to FIGS. 2A, 2B, 2C and 2D, a magnified view of the test apparatus 140 is depicted engaged to the drive train 110 for pressure testing of a well servicing system. A drive mechanism 205 is used to drive the test apparatus 140. The drive mechanism 205, in accordance with the present embodiment, can be a hydraulic motor or an electric motor. In this example, a hydraulic motor 205 is used because of the readily available hydraulic power to drive auxiliary subsystems, such as lubrication and cooling, which currently exist in the pumping equipment 100. The power for driving a hydraulic pump (that may be adapted to drive the hydraulic drive mechanism 205) is tapped from the primary mover 115 through Power-Take-Offs (PTOs) on the primary mover 115 or transmission 120 and may consist of, but not limited to, devices such as PTO gear boxes, belts and pulleys, and drive shafts. Power sources other than the primary mover 115, such as small electric motors or additional diesel power packs may also be used for driving the hydraulic drive mechanism 205. If the drive mechanism 205 is an electric motor, power may be provided from an electrical source on the pumping equipment 100, or power external to the pumping equipment 100.

Figure 2A:
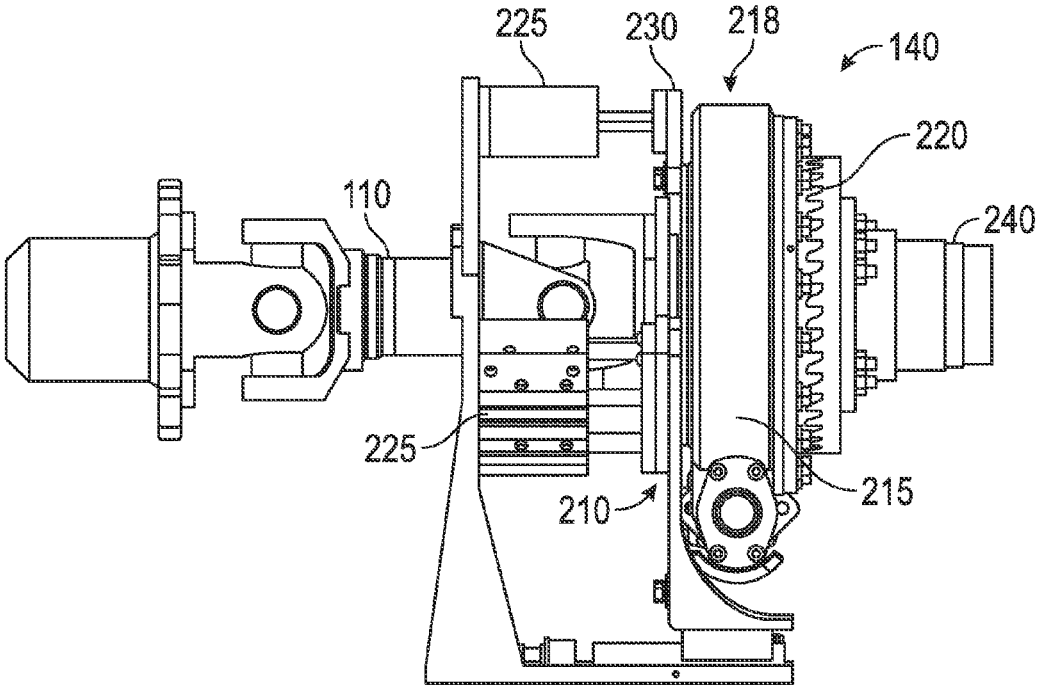
FIGS. 2A, 2B, 2C and 2D, illustrates a portion of the pumping equipment of FIG. 1B including a test apparatus for well servicing system operation in accordance with at least one aspect of the present disclosure.
Figure 2B:
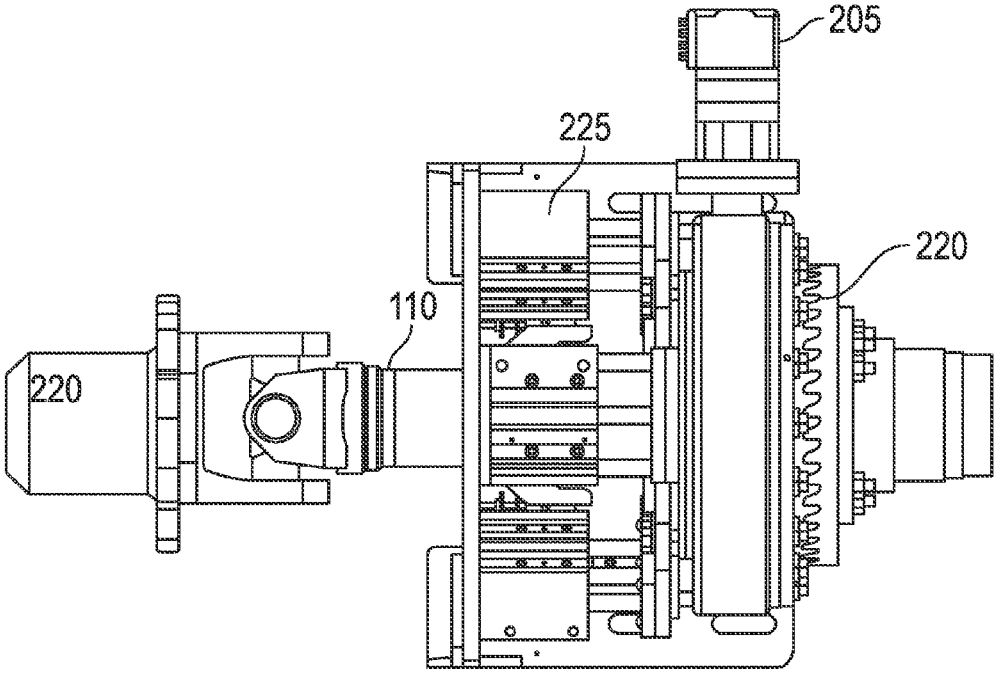
Figure 2C:
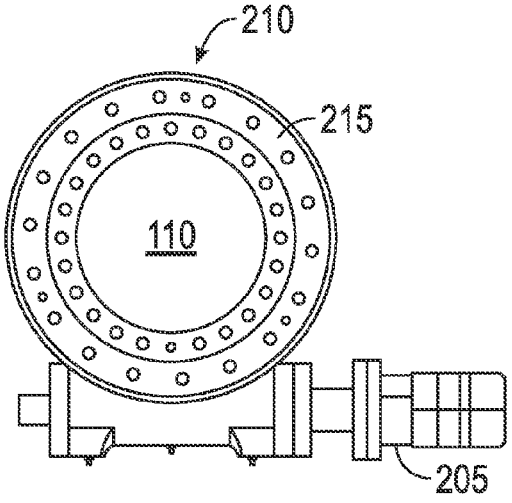
Figure 2D:
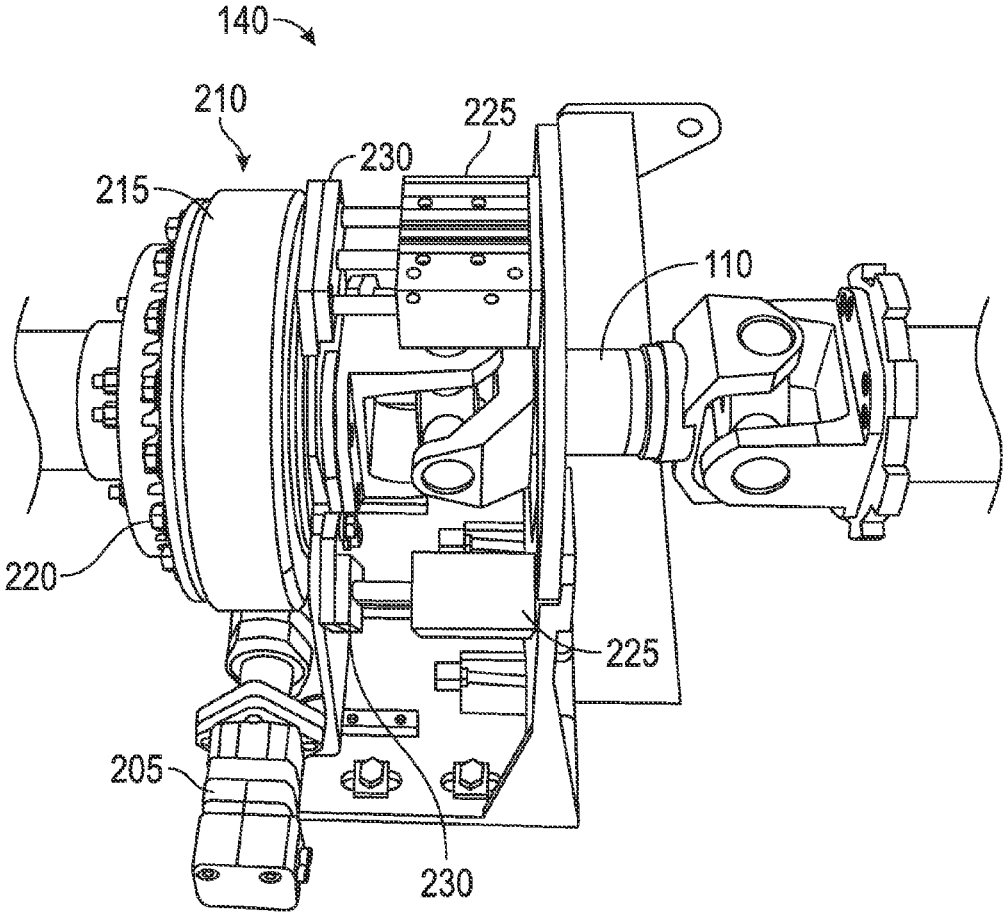

Referring specifically to the side planar view of FIG. 2A, the top planar view of FIG. 2B and the perspective view of FIG. 2D, an actuation system 210 is depicted for engaging the drive mechanism 205 with the drive train 110. The actuation system 210 includes a coupler 215, such as a worm or slew gear drive, for transferring the rotations of the drive mechanism 205 to the drive train 110 and thereby rotating the input shaft of the pump(s) 130. In order to drive the worm drive 215, an appropriate driving mechanism 205 can be determined from the requirements of the well servicing system and pumping equipment 100. The worm drive is able to advantageously provide a high torque multiplication and/or speed reduction of the drive mechanism 205, and may be selected based on its 'donut' profile (seen clearly in the front planar view of FIG. 2C) which enables the shaft of the drive train 110 to pass through the center of the coupler 215 (i.e., a through shaft "donut" configured worm drive), thus being a compact inline solution. While the worm drive provides a number of desirable features for pressure testing, it should be understood by a person skilled in the art that the coupler 215 may include any mechanism capable of providing a sufficient torque and speed, such as a planetary gear box (not shown) or a linear rack and pinion (also not shown).

The actuation system 210 also includes an engager 218 which may consist of a number of components. For example, the engager 218 may include a plurality of toothed, mating flanges 220 used for connecting/disconnecting the actuation system 210 to/from the drive train 110. One of these mating flanges 220 may be attached to the transmission 120 output hub 240 which is free to rotate when the transmission gear is in neutral, and the other mating flange may be attached to the coupler 215 which is locked (not free to rotate) if the hydraulic motor 205 does not turn. Each mating flange 220 may consist of a profile that allows the plurality of mating flanges 220 to be self-locating, and engage the reciprocal plurality of mating flanges 220. The drive mechanism 205, coupler 215, and one half of the mating flanges 220 (locked flange), are extended/retracted using pneumatic or hydraulic pistons 225 that are bolted to the non-rotating coupler (worm drive) housing via plates 230. When in pressure test mode, the pistons 225 are extended, causing the mating flanges 220 to engage. When in normal pumping mode, the pistons 225 are retracted, causing the mating flanges 220 to separate and disengage. The engage and disengage actions are conducted at static conditions when the drive train 110 is not rotating and the speed of extend and retract can be varied by adjusting the piston pneumatic or hydraulic supply pressure. Conducting this operation when the drive train 110 is static in accordance with the present embodiment is advantageous when designing for applications in hazardous areas where sparks shall not be created when the probability for flammable gas or dust to be present in the environment exists. Alternatively, if desirable, the mating flanges 220 may be engaged and disengaged when the drive train 110 is rotating by using, for example, a clutch mechanism (not shown).

Figure 3:
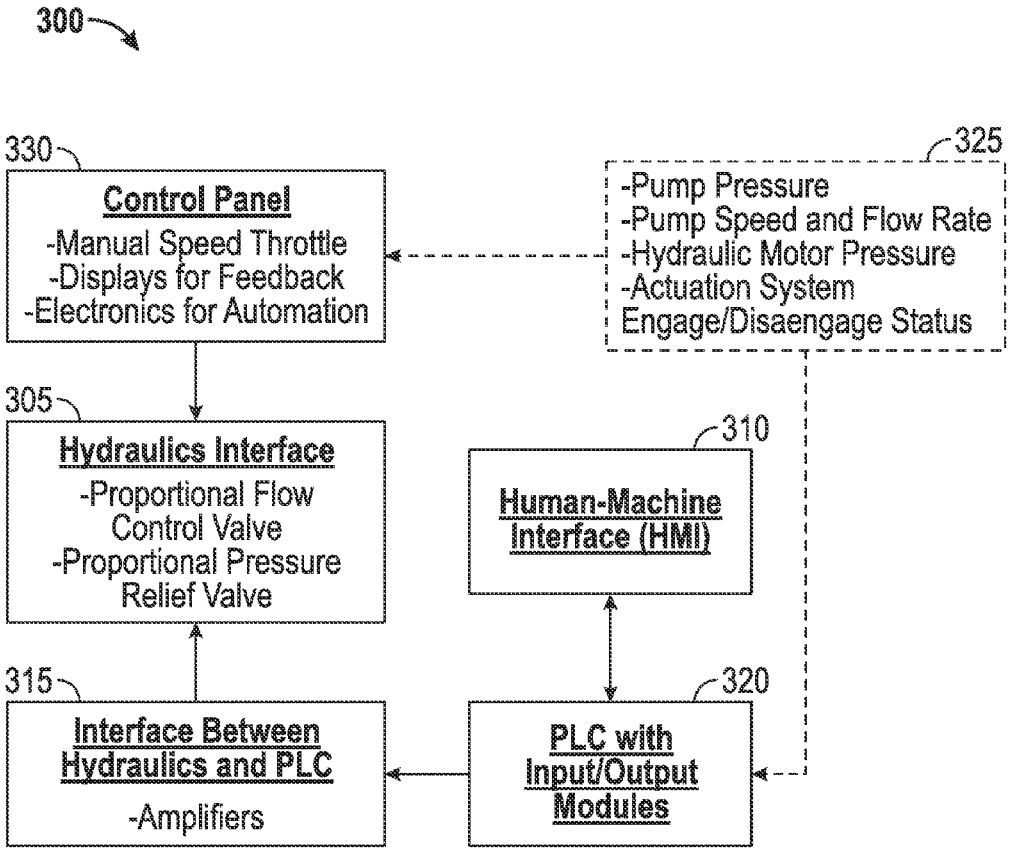
FIG. 3 illustrates a hydraulics interface and control system for the well servicing system test apparatus 140 depicted in FIG. 2 in accordance with at least one aspect of the present disclosure.

Referring to FIG. 3, a block diagram 300 depicts a hydraulic control system for operation of the pressure testing equipment 140 in accordance with at least one embodiment of the present disclosure. Hydraulic interface components 305 include a Proportional Flow Control Valve which regulates hydraulic flow supplied by a separate hydraulic pump, into the hydraulic motor 205 thereby influencing its speed, and a Proportional Pressure Relief Valve which is set to a maximum allowable hydraulic working pressure. The Proportional Flow Control Valve can be controlled to a precision level that is orders of magnitude higher than what can be obtained from conventional pressure testing methods using well services pumping equipment 100. A Programmable Logic Controller (PLC) 320 is used to control the Proportional Pressure Relief Valve (and hence hydraulic motor 205) and can be operated in manual mode through a virtual Human Machine Interface (HMI) 310 or in automated mode using a designed algorithm programmed into the PLC 320. The PLC interface to the proportional valves are amplifiers 315 which are needed to convert a standard PLC control signal (e.g., 0-10 Volts Direct Current analogue) to a Pulse-Width Modulation (PWM) signal that will control the electrical solenoid on the valve (e.g., 0-24 Volts PWM) to set the desired valve spool position. When the drive mechanism 205 is an electric motor, a control system comparable to the hydraulic control system described herein above may comprise electrical circuitry compatible for a fixed motor speed, or may utilize a Variable Speed Drive (VSD) for extending the operating envelope.

Some other inputs to the PLC 320 are sensors 325 that read the pump pressure, speed and flow rate, the hydraulic motor pressure, and the status of the drive (engaged or disengaged). During pressure testing, the pump pressure is necessary as feedback for either manual or automated operations. The hydraulics valves can also be operated manually through a physical Control Panel 330, using controls such as throttles, and displays for sensor feedback. Instead of a PLC, automation can also be engineered using electronics (switches, circuit boards, etc.) on the Control Panel 330.

In the instance that the volume to be pressure tested is large, such as testing a subsea Blow-Out Preventer (BOP) up to maximum working pressure (e.g., 15,000 pounds per square inch (psi)), the apparatus described here may require a much longer time than the current 'bumping' method which is able to displace and compress more fluid by turning the pump faster. When time is a consideration, it can conveniently be addressed by combining the two approaches: i.e., bumping up to a certain pressure close to the target (e.g., 80% target pressure), and then letting the apparatus 140 take over operation in accordance with the present embodiment to bring the pressure up accurately to the target. This is also complimentary to the behaviour of test fluids such as water which have compressibility that decreases with pressure increase, e.g., more fluid is to be displaced to bring the pressure up from 0 to 1000 pounds per square inch, hence a less precise and less sensitive approach is acceptable, compared to bringing up the pressure from 2000 to 3000 pounds per square inch where a relatively more precise and more sensitive approach is needed.

Figure 4:
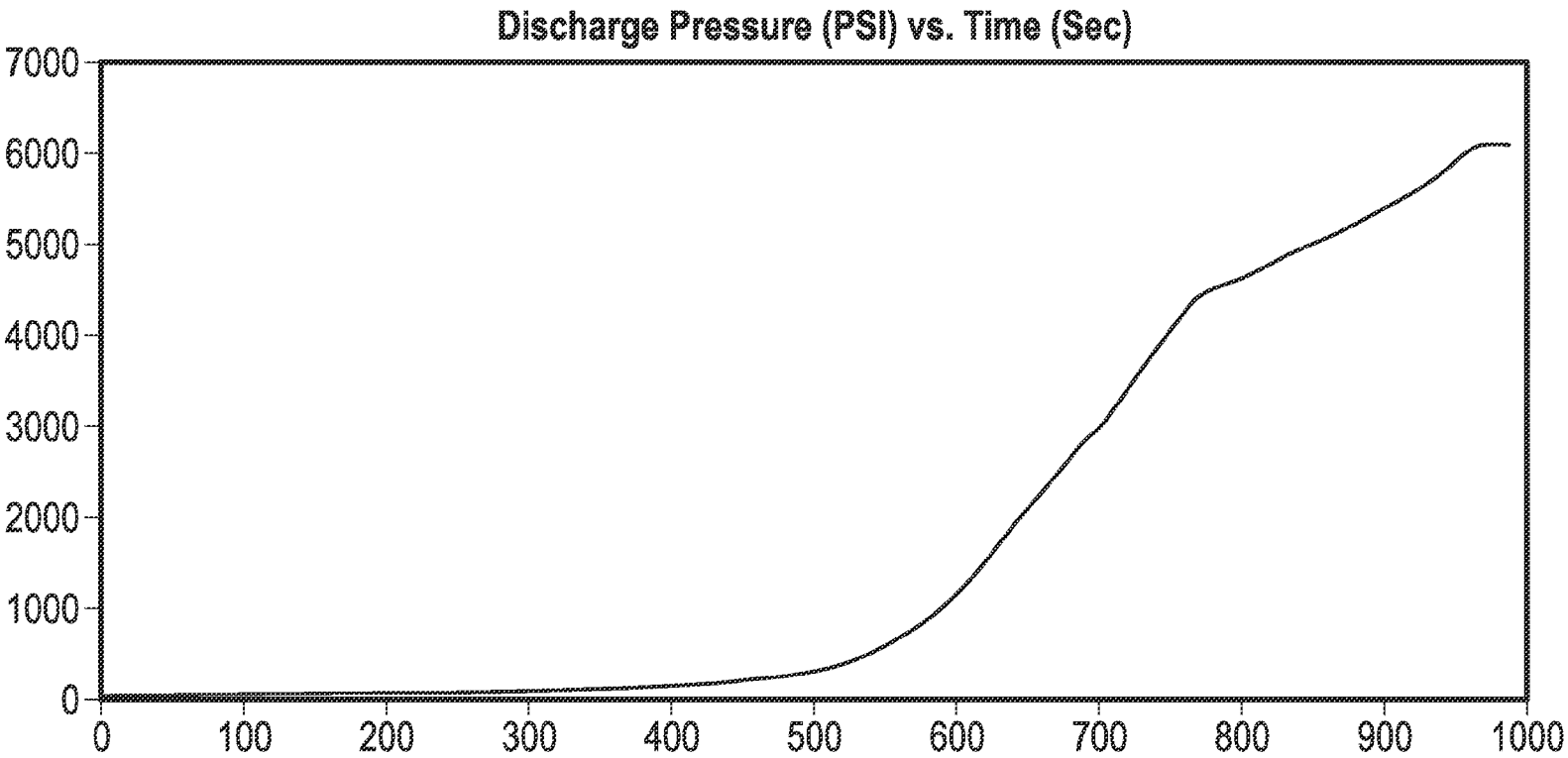
FIG. 4 graphically depicts discharge pressure vs. time of hydrostatic pressure testing utilizing the well servicing system test apparatus depicted in FIG. 2 in accordance with at least one aspect of the present disclosure.

FIG. 4 depicts the pressure versus time graph of a well servicing system that was pressure tested in accordance with the present embodiment. In this graph, the pump was rotated at two different speeds as evident with the change in slope at 4,500 pounds per square inch. As it can be seen, although the pressure rise is desirable (i.e., smooth and gradual), the apparatus 140 takes some time to bring the system to the target 6,000 pounds per square inch pressure. Those skilled in the art will realize that such a system could be brought to full pressure more quickly by the combined techniques of 'bumping' to a pressure close to the target then letting the apparatus 140 take over. It is important to note that the interpretation of 'long' duration is relative and assessed on a case by case basis. The duration of the test depends on a number of factors such as how fast the pump is turned, the volume of fluid being compressed, the compressibility of the fluid, the elasticity of the treating lines, the level of conservatism required to avoid over-pressure, etc. In FIG. 4, for initial testing and safety purposes, the pump was conservatively turned at a very low speed of 3.5 and 12.0 times slower than the maximum speed achievable by the test apparatus, implying that the duration of the test could be significantly reduced if the drive was sped up.

The present embodiment provides the rotary drive mechanism 205 which may be used to turn the pump input shaft independent of the primary mover 115. This mechanism 205 alone may not provide the torque required to turn the pump to meet the pressure requirements, hence it may require a high gear reduction. One such drive mechanism 205 that caters to this requirement is a worm gear drive 215. Typically worm drives have a very high gear ratio which provides high torque multiplication and high speed reduction. Therefore the pump can be precisely controlled by controlling the rotations imparted to the worm shaft by the drive mechanism 205.

With the new methodology of pressure testing in accordance with the present embodiment adapted to turn the pump shaft using a worm drive that is precision controlled using a hydraulic system, an accurate pressure test within ±2.5% of the target test pressure can be performed. This accuracy is within typical acceptance margins used. Furthermore, initial testing has shown that the system is able to achieve even more precise results than the predicted accuracy (i.e., more precise than typical acceptance margins). With the ability to automate the hydraulics controls, the accuracy of the pressure testing can be achieved each time, thus improving overall system reliability.

Many configurations of pumping equipment 100 that utilize transmissions 120 are also limited in their ability to perform low rate pumping of an open well servicing system. The definition of an open well servicing system is one that is not contained, and will enable flow consistently. The definition of low rate is the lower range of pumping flow rates from zero onwards that cannot be achieved reliably and consistently when using the primary mover 115. The limitation in ability to perform low rate pumping is due to the minimum input speed requirement of running the transmission 120 in mechanical lockup mode which is used for normal pumping operations (e.g., 1600 revolutions per minute (rpm)). Currently, lower flow rates are achievable by running the transmission 120 at speeds below mechanical lockup, such as running the transmission 120 in torque converter or fluid coupling mode where the stator and turbine are disengaged, and selecting an appropriate gear to obtain the target flow rate. For example, running the transmission input speed at 600 revolutions per minute based on the RIC engine idling speed, and selecting the first gear with highest speed reduction. The primary issue with this method is that the output speed of the transmission 120, which is the input speed to the pump, is dependent on the load seen by the pump; this is reflected by the pressure seen at the pump discharge which may vary throughout the course of an operation. The higher the load, the slower the flow rate and the lower the load, the higher the flow rate. This makes the method difficult to control and less reliable compared to when the transmission 120 is operated in lockup mode where the stator and turbine are mechanically engaged and will provide a fixed flow rate independent of the pump discharge pressure. Another issue with operation in torque converter mode is high heat rejection due to the fluid slippage that occurs when the stator and turbine are not mechanically engaged; this may lead to cooling issues for equipment originally designed for pumping in lockup mode.

Figure 5:
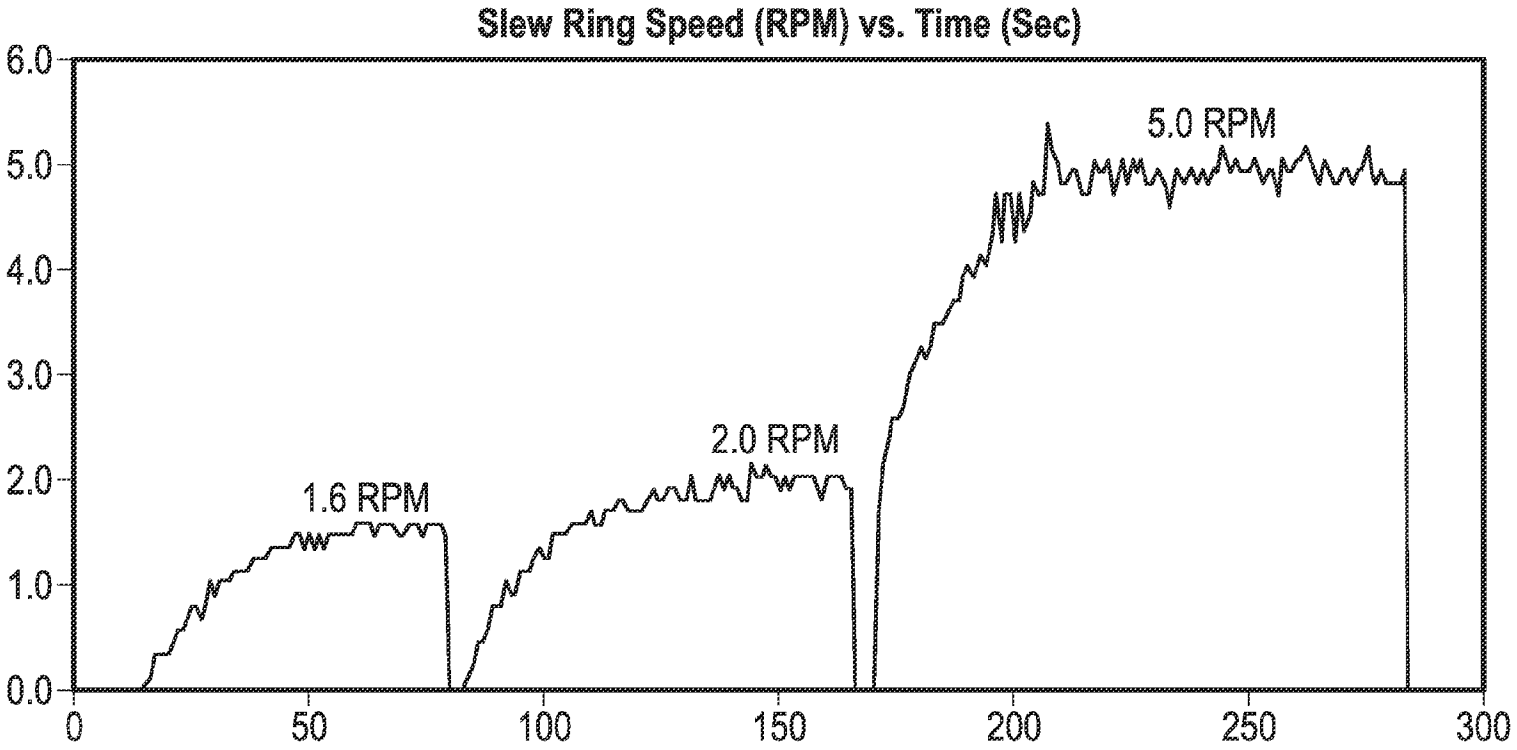
FIG. 5 graphically depicts the pump input speed vs. time of low rate pumping utilizing a variant of the well servicing system test apparatus depicted in FIG. 2 in accordance with at least one aspect of the present disclosure.

In accordance with the present embodiment, a design can be engineered based on low rate pumping specifications that will also provide this service for pumping equipment 100 that has combinations of transmissions 120 and primary movers 115 that are unable to perform low rate pumping in transmission mechanical lockup mode or independent of the load (pressure). This is achieved without using the primary mover where "without using the primary mover 115" for low rate pumping refers to not using the primary mover 115 for driving the drive train 110 during low rate pumping of the well servicing system in the way current methods, such as pumping in transmission torque converter mode and transmission mechanical lockup mode, use the primary mover 115. Referring to FIG. 5, an example graph of the slew/worm ring 215 speed versus time is depicted, where a simple Proportional, Integral, Derivative (PID) controller in the PLC system was used to achieve different set points, by controlling the Proportional Flow Control Valve spool. It can be seen that the 3 set points of 1.6 revolutions per minute, 2.0 revolutions per minute and 5.0 revolutions per minute were reached and maintained.

The coupler 215 couples the drive mechanism 205 to the pumping equipment 100 and may comprise a worm gear drive with a predetermined gear ratio. The predetermined gear ratio is either a first predetermined gear ratio satisfying pressure testing requirements or a second predetermined gear ratio satisfying low rate pumping requirements. The drive may also be of a single predetermined gear ratio that will satisfy both pressure testing and low rate pumping requirements. Alternatively, if the coupler 215 consists of a gearing mechanism (not shown) with multiple gear ratios and is used to extend the operating envelope, the gear ratio may be selectively switched between a number of predetermined gear ratios, for use to cover both pressure testing and low rate pumping requirements (not shown). It should be noted that the desired output to turn the pump 130 to perform pressure testing and/or low rate pumping will depend on an appropriately selected drive mechanism 205 in terms of speed and torque operating range, and coupler 215 in terms of gear ratio(s), this may also include the control system such as 300 used to operate the drive mechanism 205 across a range of speeds and torque.

Thus, it can be demonstrated that the present embodiment can provide a reliable hydrostatic pressure test apparatus and method which can overcome the present drawbacks and reduce or completely eliminate over-pressure incidents, while reliably achieving repeatability and accuracy in hydrostatic pressure testing. Initial testing has also shown that the response time, in the event of the pump discharge pressure overshooting the maximum allowable pressure, for the worm drive to stop rotating when hydraulic flow is cut to the motor is significantly faster than known Over-Pressure Shut-Down (OPSD) systems that are based on one or more combinations of controlling the transmission 120 (shifting to neutral), controlling the primary mover 115 (going to idling speed or shutting down), and using an external braking system to stop the output of the transmission. Hence, various apparatus in accordance with the present embodiment can provide an improved version of OPSD which can be implemented when the hydraulic flow to the motor is cut immediately in the event of over-pressure. In addition, the present embodiment provides methods for pressure testing utilizing the minimal additional equipment described herein, including hydrostatic pressure testing and low rate pumping. While exemplary embodiments have been presented in the foregoing detailed description, it should be appreciated that a vast number of variations exist.

Although the present disclosure has been described with reference to exemplary embodiments and implementations thereof, the present disclosure is not to be limited by or to such exemplary embodiments and/or implementations. Rather, the systems and methods of the present disclosure are susceptible to various modifications, variations and/or enhancements without departing from the spirit or scope of the present disclosure. Accordingly, the present disclosure expressly encompasses all such modifications, variations and enhancements within its scope.

What is claimed is:

1. An apparatus for use with pumping equipment of a well servicing system having a primary mover coupled to a pump by a drive train, the primary mover having at least two discrete operating levels, the apparatus comprising:

a drive mechanism, distinct from the primary mover and the drive train, for performing pumping equipment pressure testing, the drive mechanism powered by the prime mover and being configured to operate between at least two of the discrete operating levels; and an actuation system coupled to the drive mechanism for selectively engaging the drive mechanism with the drive train, the drive mechanism, when engaged with the drive train, configured to rotate the drive train and the pump without using the primary mover, thereby enabling pressure testing of the pumping equipment of the well servicing system.

2. The apparatus in accordance with claim 1 wherein the drive mechanism comprises an electric motor.

3. The apparatus in accordance with claim 1 wherein the drive mechanism comprises a hydraulic motor.

4. The apparatus in accordance with claim 1 wherein the actuation system comprises:

a coupler connected to the drive mechanism; and an engager for engaging the coupler to the drive train for the pressure testing of the well servicing system without using the primary mover and for disengaging the coupler from the drive train for operations other than the pressure testing and low rate pumping of the well servicing system.

5. The apparatus in accordance with claim 4 wherein the coupler comprises a worm gear drive.

6. The apparatus in accordance with claim 4 wherein the engager comprises an engager for engaging the coupler to the drive train, the engager operating in a manner selected from the group of pneumatically operating, electrically operating and hydraulically operating.

7. The apparatus in accordance with claim 1 wherein the system pressure testing comprises hydrostatic pressure testing, and wherein the actuation system selectively engages the drive mechanism to the drive train for the hydrostatic pressure testing of the well servicing system without using the primary mover.

8. The apparatus in accordance with claim 7 wherein the drive mechanism comprises a drive mechanism capable of applying sufficient torque capacity across an entire speed range of the drive mechanism, determined by the pressure testing requirements.

9. The apparatus in accordance with claim 1 wherein the actuation system selectively engages the drive mechanism to the drive train for the low rate pumping of the well servicing system without using the primary mover.

10. The apparatus in accordance with claim 9 wherein the drive mechanism comprises a drive mechanism providing a predetermined flow rate within the well servicing system by providing a predetermined speed and sufficient torque to maintain the flow rate.

11. The apparatus in accordance with claim 1 wherein the pumping equipment of a well servicing system includes a transmission, and wherein the transmission causes the primary mover to have the discrete operating levels.

12. A method for hydrostatic pressure testing a well servicing system using pumping equipment including a primary mover coupled by a drive train comprising a transmission to a pump, the primary mover having at least two discrete operating levels, the method comprising the steps of:

putting the transmission into neutral to disengage the primary mover from the drive train;

containing the well servicing system;

engaging a hydrostatic pressure testing drive mechanism with the drive train while the transmission is in neutral; and activating the hydrostatic pressure testing drive mechanism to engage with and rotate the drive train for pumping and compressing test fluid into the well servicing system with the pump without using the primary mover, wherein the hydrostatic pressure testing drive mechanism is configured to operate between at least two of the discrete operating levels of the primary mover.

13. The method in accordance with claim 12 wherein the step of containing the well servicing system comprises the step of closing valves in the well servicing system and wherein the primary mover is controlled by going to idle or shutting down.

14. The method in accordance with claim 12 wherein the engaging step comprises the step of engaging the hydrostatic pressure test drive mechanism to drive the drive train for pumping and compressing test fluid into the well servicing system to a predetermined pressure and holding it for a predetermined time.

15. The method in accordance with claim 12 further comprising the step of disengaging the hydrostatic pressure test drive mechanism when not required for hydrostatic pressure testing of the well servicing system.

16. A method for low rate pumping of an open well servicing system using pumping equipment and including a primary mover coupled to the pumping equipment by a drive train comprising a transmission, wherein at least one of the primary mover and the transmission have at least two discrete operating levels, the method comprising the steps of:

putting the transmission into neutral;

engaging a low rate pumping drive mechanism with the drive train at a point in the drive train between the transmission and the pumping equipment, wherein the low rate pumping drive mechanism is configured to operate between at least two of the discrete operating levels; and activating the low rate pumping drive mechanism to engage with and rotate the drive train for pumping fluid into the well servicing system with the pump at a predetermined flow rate without using the primary mover, wherein the low rate pumping drive mechanism is powered by the primary mover.

17. The method in accordance with claim 16 further comprising the step of disengaging the low rate pumping drive mechanism when not required for low rate pumping of the well servicing system.

18. A well services pumping system comprising:

pumping equipment comprising a primary mover for driving the pumping equipment, the primary mover having at least two discrete operating levels;

a drive mechanism separate from the primary mover and configured to operate between at least two of the discrete operating levels; and a coupler with a predetermined gear ratio for coupling the separate drive mechanism to engage with and rotate the pumping equipment when the coupler is engaged with the pumping equipment while the primary mover is unable to rotate the pumping equipment, where the predetermined gear ratio is selected from a first predetermined gear ratio satisfying pressure testing requirements, a second predetermined gear ratio satisfying low rate pumping requirements or a third predetermined gear ratio satisfying both pressure testing requirements and low rate pumping requirements, wherein at least one of the first, second, and third gear ratios is configured to operate between at least two of the discrete operating levels.

19. The well services pumping system in accordance with claim 18 wherein the coupler further comprises a gearing mechanism with a plurality of gear ratios for extending the operating envelope thereof, the coupler capable of being selectively switched between ones of the plurality of gear ratios for pressure testing requirements and for low rate pumping requirements.

* * * * *